US005404148A

United States Patent [19]

Zwarts

[11] Patent Number: 5,404,148

[45] Date of Patent: Apr. 4, 1995

[54] PHASED ARRAY ANTENNA MODULE

[75] Inventor: Johan M. C. Zwarts, Borne, Netherlands

[73] Assignee: Hollandse Signaalapparaten B.V., Hengelo, Netherlands

[21] Appl. No.: 980,696

[22] Filed: Nov. 24, 1992

[30] Foreign Application Priority Data

Nov. 27, 1991 [NL] Netherlands ..... 9101979

[51] Int. Cl.[6] ..... H01Q 13/00

[52] U.S. Cl. ..... 343/776; 343/754; 343/772; 343/774; 343/777; 343/778; 343/786; 343/853

[58] Field of Search ..... 343/776, 853, 772, 774, 343/777, 778, 754, 786; 333/137, 134, 125

[56] References Cited

U.S. PATENT DOCUMENTS

| | | | |
|---|---|---|---|
| 3,698,000 | 10/1972 | Landry et al. | 343/786 |
| 3,825,932 | 7/1974 | Hockham | 343/776 |
| 4,096,482 | 2/1978 | Walters | 343/776 X |
| 4,338,609 | 7/1982 | Landry | 343/786 |
| 4,675,678 | 6/1987 | Klingenschmitt et al. | 342/34 |
| 4,734,660 | 3/1988 | Lofgren | 343/786 |
| 4,851,856 | 7/1989 | Altoz | 343/720 |

FOREIGN PATENT DOCUMENTS 448318 9/1991 European Pat. Off. .

OTHER PUBLICATIONS

Armitage, Microwave Journal, vol. 29, No. 2, Feb. 1986, pp. 109–110, 112, 114, 116, 120 and 122. "Electronic Warfare Solid-State Phased Arrays".

Claridge, et al., 19th European Microwave Conference 1989, Sep. 1989, pp. 1131–1140. "Design of a Phased Array Antenna Using Solid State Transmit/Receive Modules".

Kinzel, et al., Microwave Journal, vol. 30, No. 1, Jan. 1987, pp. 89–90, 92, 94, 96, 98, 100 and 102. "V-Band, Space-Based Phased Arrays".

Zahn, et al., IGARSS '89 12th Canadian Symposium on Remote Sensing, Jul. 1989, pp. 2269–2272. "A Phased Array Bread Board for Future Remote Sensing Applications".

Chen. G-AP International Symposium, Aug. 1973, pp. 376–377. "Octave Band Waveguide Radiators for Wide-Angle Scan Phased Arrays".

*Primary Examiner*—Donald Hajec
*Assistant Examiner*—Steven Wigmore
*Attorney, Agent, or Firm*—Oblon, Spivak, McClelland, Maier, & Neustadt

[57] ABSTRACT

An antenna having antenna modules for an extremely wideband active monopulse phased array system, the modules including a housing provided with four radiators of the rectangular open-ended waveguide type and with an electric circuit. With the antenna modules being suitably stacked, the radiators constitute a substantially continuous antenna surface, the radiators being positioned at the points of intersection of a system of equilateral triangles which make up the antenna surface. After preamplification, phase shift and down-conversion to an intermediate frequency, received signals from a large number of antenna modules are combined to yield a sum beam, an azimuth difference beam and an elevation difference beam.

13 Claims, 6 Drawing Sheets

PHASED ARRAY ANTENNA MODULE

BACKGROUND OF THE INVENTION

The invention relates to an antenna module for an active monopulse phased array system, comprising a housing provided with an electric circuit, on a first side provided with a radiator for the transmission and reception of RF signals, further provided with connecting means for RF signals, control signals and supply voltages, the electric circuit being suitable for driving the radiator at a controllable phase.

By a phased array system is meant a system made up of large numbers of individual antenna modules (usually thousands) for the unidirectional transmission of RF signals and for the unidirectional detection of RF signals, the direction being chosen by varying at least the phase shift of the RF signals in all antenna modules. Phased array systems have predominantly been used in radar applications, although they may also be considered for the illumination of outgoing missiles or for satellite communication.

A phased array system for fire control applications is preferably designed as a monopulse system, so as to produce error voltages during target tracking.

If the transmitted RF signals are generated in the individual antenna modules, use being made, though, of RF signals generated from a central point, then we have an active phased array system. An active system has the advantage of being extremely reliable. Even a breakdown of for example 10% of the antenna modules will hardly affect the performance of an active phased array system.

A phased array system is always a compromise, certain specific system requirements being attained at the expense of other requirements.

SUMMARY OF THE INVENTION

The specific system requirement pertaining to the multifunctional active monopulse phased array system according to the invention is a large bandwidth, considerations such as maximum scanning angle and cost, also of great importance, being nevertheless pushed into the background. It presently appears that the specific system requirement is practically entirely embodied in the antenna module according to the invention, which is characterized in that the radiator, the electric circuit and the geometry of the housing have been chosen for the combined realisation of a large system bandwidth.

Phased array systems according to the state of the art practically only use radiators of the dielectric type, which are compact and can consequently be simply arranged in a plane. Dielectric radiators are, however, of a narrow-band nature. The antenna module according to the invention is therefore characterized in that the radiating element is of a rectangular open-ended waveguide type and that the widest side of the radiator is at least substantially 3.5 times its height h.

The disadvantage of a wide, flat radiator is that it is virtually impossible to insert the required electric circuit in the space behind the radiator. The antenna module according to the invention is therefore characterized in that the first side is provided with N (N=2, 3, 4 . . . ) identical radiators, arranged in line and in that the electric circuit is suitable for simultaneously driving N radiators.

A favorable embodiment of the antenna module is characterized in that the housing comprises a flat box, a bottom surface of which acts as a heat sink for removing heat generated in the electric circuit and a side of which constitutes the first side on which the radiators are positioned at interspaces of at least h.

The bottom surface of an antenna module according to the invention can then be mounted on a cooling plate, the radiators entirely protruding beyond the cooling plate, such that the radiators of the modules mounted on one side of the cooling plate accurately fit in between the radiators of the modules mounted on the other side of the cooling plate.

An advantageous geometry of the modules and the cooling plates and an advantageous arrangement of the radiators on the first side of the modules has as a result that in a stack of cooling plates provided with modules, the free ends of the radiators will constitute an at least substantially continuous surface.

Further, the wideband matching of a rectangular open-ended waveguide radiator to a conventional coaxial output of an electric circuit is not devoid of problems, which renders the use of this type of radiator in phased array systems less attractive. The radiator according to the invention obviates this drawback and is characterized in that each radiator is connected to the electric circuit and is provided with an integrated matching unit, comprising a terminal for a coaxial lead-through, a coaxial to stripline transition, a stripline mode to waveguide mode transition and an impedance transformer towards the open waveguide end.

In order to derive monopulse signals from the phased array system, sum signals received by the modules may be summed at RF level, as is common practice in radar technology. RF networks capable of generating sum and difference beams at low sidelobes are found to reduce the bandwidth. Moreover, they are extremely complex and expensive. A phased array system incorporating the antenna module according to the invention sums the received signals at IF level, which obviates said drawbacks. To this effect, the antenna module is characterized in that the electric circuit comprises a receiver which is provided with at least a preamplifier, a controllable phase shifter and an image rejection mixer.

An extremely wideband superheterodyne receiver, as used in the antenna module according to the invention can only be implemented in a single super design. In view of this, the image rejection mixer has to satisfy strict requirements. The antenna module is therefore characterized in that the image rejection mixer is designed as an MMIC.

BRIEF DESCRIPTION OF THE DRAWINGS

The invention will now be described in more detail with reference to the following figures, of which.

DETAILED DESCRIPTION OF THE INVENTION

An active monopulse phased array system primarily consists of a large number of antenna modules, where each antenna module is provided with a radiator and where the radiators in combination constitute the antenna surface. In view of both price and performance, the design of the module is essential. A universal optimal solution does not exist, the solution is to a considerable extent dependent on the requirements pertaining to the phased array system.

Additionally, an active monopulse phased array system comprises means on which the antenna modules may be mounted. Apart from the actual fastening devices, these means include cooling devices, a distribution network for supply voltages and for RF transmitting signals. Moreover, it contains summation networks for summing the signals received by the modules to yield $\Sigma$, $\Delta B$, and $\Delta E$ output signals.

The phased array system incorporating the antenna module according to the invention, requires an extremely large bandwidth. This system requirement affects the antenna geometry itself, as well as the choice of the radiator type, the electric circuit which excites the radiator and the summing networks. These four aspects and their interrelation form the subject of this patent specification.

Figure 1A:
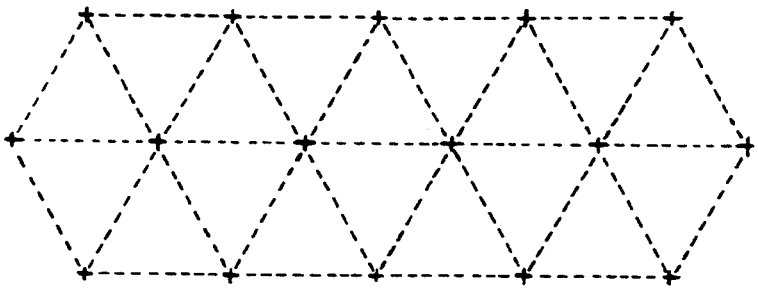
FIG. 1A and FIG. 1B represent the state of the art and FIG. 1G represents a geometry according to the invention.
Figure 1B:
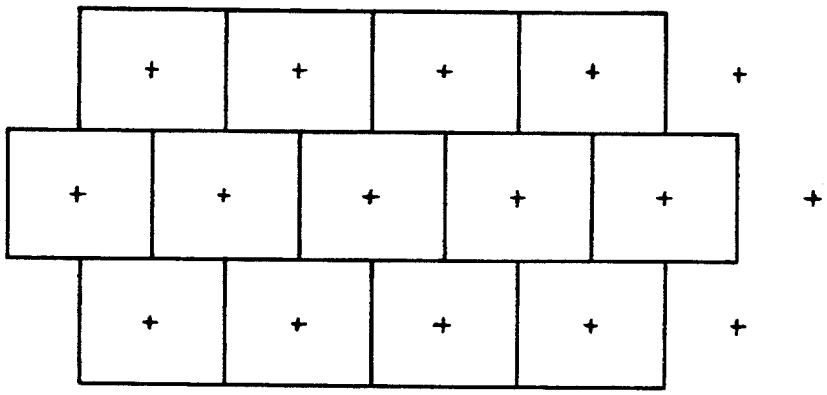

FIG. 1A shows a conventional antenna geometry. In this example, the antenna surface is divided into equilateral triangles with a radiator in each point of intersection. In such a phased array system performing radar transmissions at a wavelength $\lambda$, beam formation is possible without the occurrence of undesirable grating lobes, wellknown in the art, provided that the spacing between the radiators does not exceed $\lambda/2$. Conversely, if d is the spacing between the radiators, grating lobes may appear if $\lambda<2d$. If, for instance, dielectric radiators are used, the antenna modules may be stacked as shown in FIG. 1B, according to a method known in the art.

If a rectangular open-ended waveguide is used as radiator, and if full advantage is to be taken of the large bandwidth of this radiator type, the width of the waveguide is required to exceed $\lambda/2$, to prevent the waveguide from entering the cutoff mode. FIG. 1G shows a stack of this radiator type which fulfills these conditions. In this figure, the width of the radiator is $\sqrt{3}$ d and its height is 0.5 d. If we combine the conditions for the non-occurrence of grating lobes and cutoff, $\lambda<2\sqrt{3}$ d and $\lambda>2d$, which for the antenna geometry results in a theoretically feasible bandwidth of almost 50%. Particularly, if the phased array system transmits at a small radar wavelength, the small height of the radiator may render the design of an antenna module, including an electric circuit, in a position coaxial with the radiator practically impossible.

Figure 2:
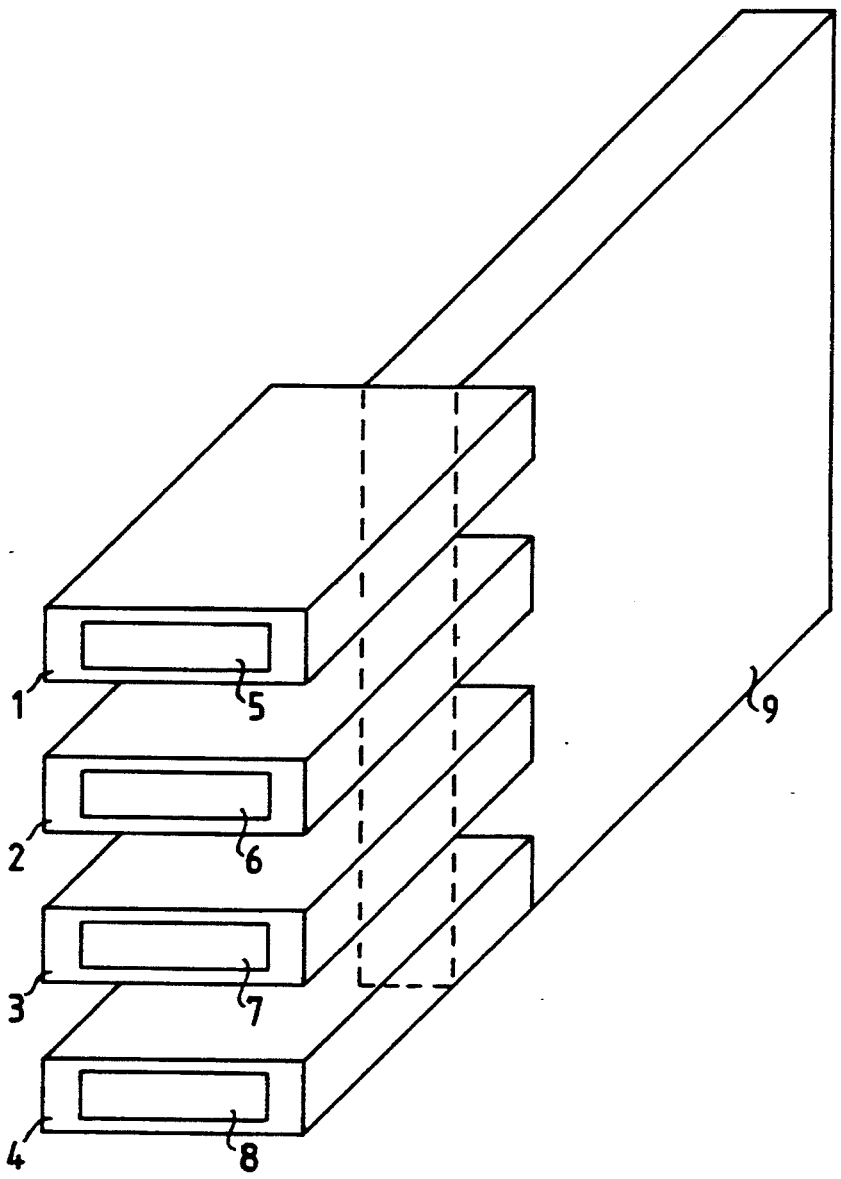
FIG. 2 represents a possible embodiment of an antenna module according to the invention.

FIG. 2 shows an antenna module, which does not experience this drawback. Radiators 1, 2, 3 and 4 provided with rectangular radiating apertures 5, 6, 7, 8 are mounted on a Joint housing, incorporating an electric circuit for actuating the radiators. The housing is provided with connecting means, usually on the side turned away from the radiators, via which the antenna module receives an RF signal, which upon amplification and phase shift may be applied to the radiators. RF signals received by the radiators may upon amplification and phase shift, also be applied to the connecting means via the electric circuit. Further, the connecting means receive supply voltages for the electric circuit and control signals for governing the gain and phase shift of the transmitter and receiver signals.

An additional advantage of the antenna module according to the invention is, that distribution networks in the phased array system for the distribution of supply voltages, control signals and RF signals can be implemented in a more simple design, whilst also the number of connecting means compared against modules according to the state of the art has been reduced by a factor of four. The assumption that a module should contain as many radiators as possible in order to make the most of this advantage, might be a logical one. This however, not the case; for logistic reasons, the price and degree of complexity of this replaceable building block shall not be too high. If these factors are taken into account, four radiators per antenna module is an optimal amount.

Figure 3:
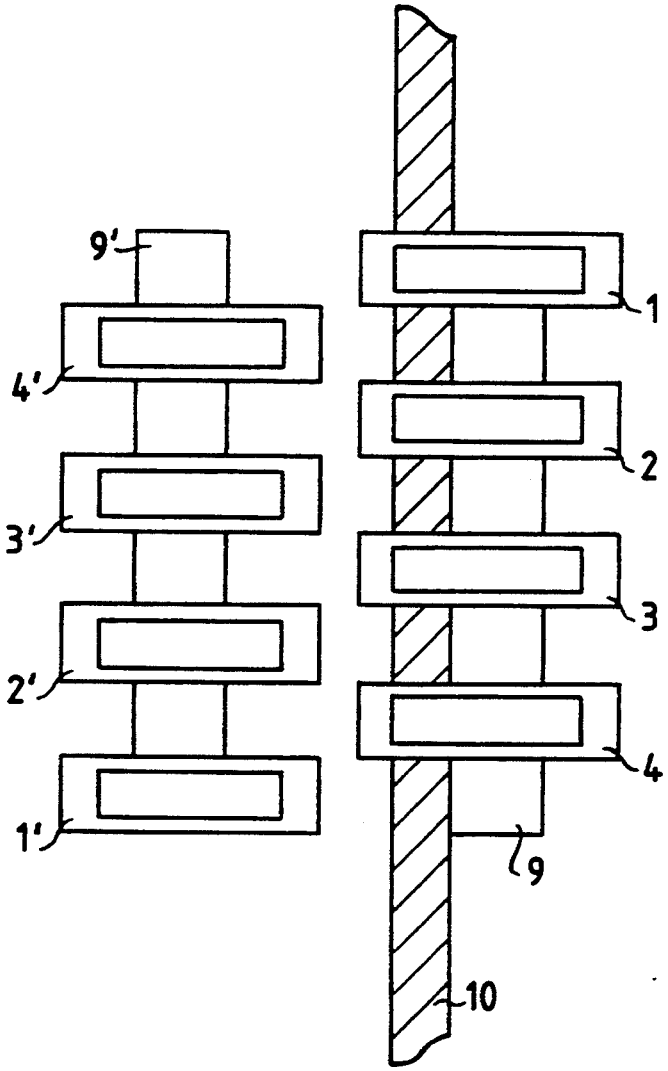
FIG. 3 represents the positioning of the antenna modules against a cooling plate.

FIG. 3 shows the abutment of the housings 9 and 9' against cooling plate 10. Radiators 4', 3', 2', 1' will accurately fit in between radiators 1, 2, 3, 4, with a 50% overlap. This enables a number of cooling plates provided with antenna modules to be stacked, the radiators of the consecutive cooling plates interlocking, thus constituting a substantially continuous surface, the antenna surface.

Figure 4:
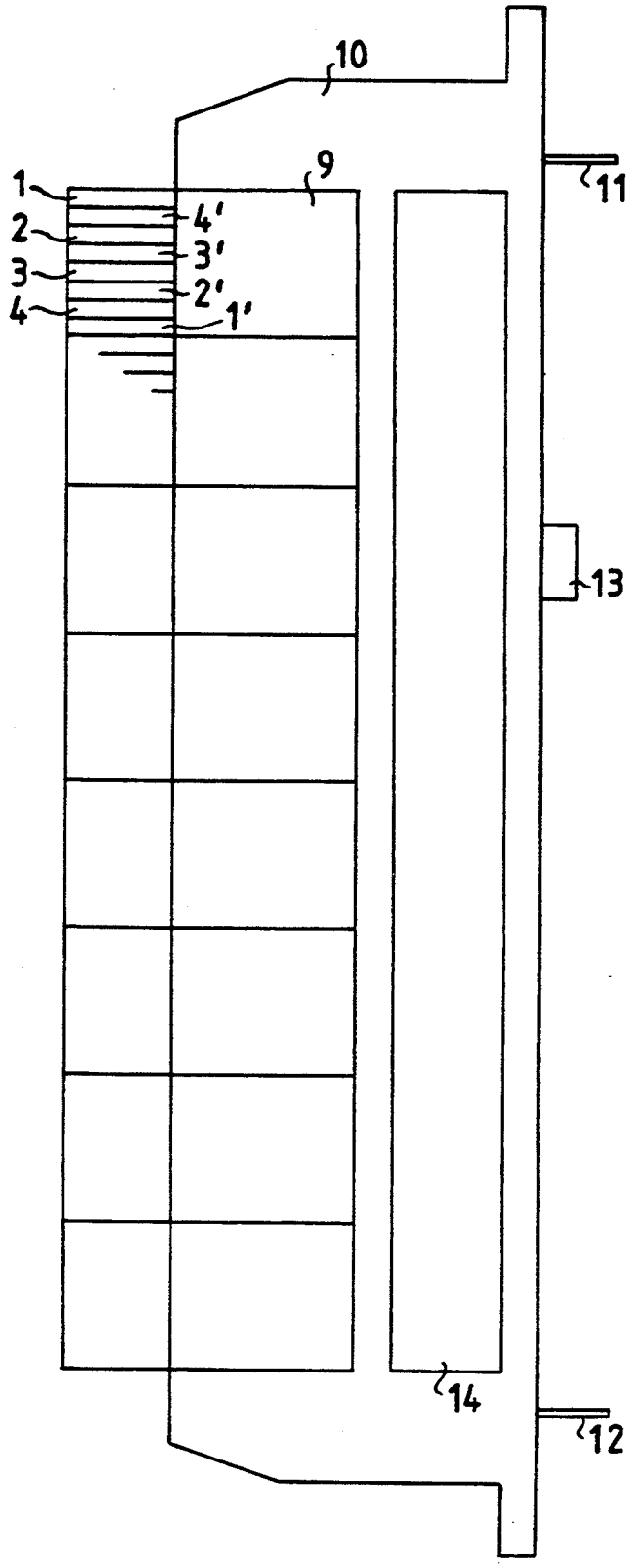
FIG. 4 represents a possible embodiment of a cooling plate, provided with antenna modules according to the invention.

FIG. 4 shows a cooling plate 10 provided with antenna modules. On both sides, cooling plate 10 is provided with, for instance, eight antenna modules. Cooling is effected by means of a coolant line mounted in the cooling plate, with an inlet 11 and an outlet 12. Cooling plate 10 is furthermore provided with a second connecting device 13, via which the modules 90 using a distribution network 14 are provided with supply voltages, control signals and RF signals.

Figure 5:
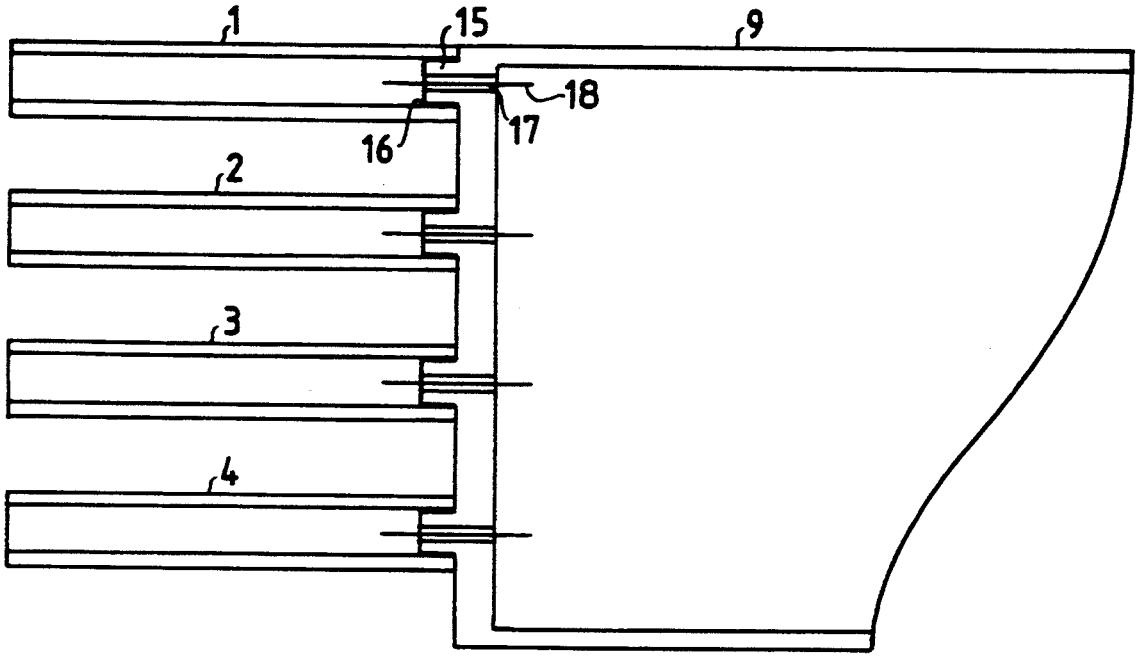
FIG. 5 illustrates the mounting of the radiators on the housing.

FIG. 5 shows in side-view the integration of radiators 1, 2, 3, 4 with housing 9. In the appropriate positions, the housing is provided with four projections 15, each having a rectangular cross-section to accommodate the radiators. A conductive connection 16 is then made between radiators and housing. If both radiators and housing are of a solderable material, this may be a soldered connection, or a conductive bonded connection, for instance by means of silver epoxy. A most advantageous connection is obtained by placing radiators and housing in a jig and clamping the radiators at the position of the projections, particularly near the bends. The resulting connection guarantees a close tolerance of the positions of the radiators with reference to the mounting face of the housing; this connection can be quickly established and can be applied on unmachined aluminum.

The projections 15 are each provided with a coaxial connection formed by a glass bead 17 and a gold-plated pin 18, which together provide a hermetic seal. This coaxial connection enables the electric circuit to supply energy to the radiator. To this effect, the radiator shall be provided with means for converting the coaxial field surrounding the coaxial connection into the waveguide field desired in the radiator, said means acting as a compensator for impedance mismatches. This is shown sectionally in FIG. 6A in side-view and FIG. 6B in top-view. To this end, radiator 1 is provided with an integrated matching unit comprising a stripline section 19, which is further provided with a gold-plated terminal for pin 18, which stripline section together with adjacent impedance transformer 20 constitutes a stripline mode to waveguide mode transition, and additional matching units 21, 22. Matching units of this sort are well known in the art, although their use in radiators of phased array systems is a novelty.

Figure 6A:
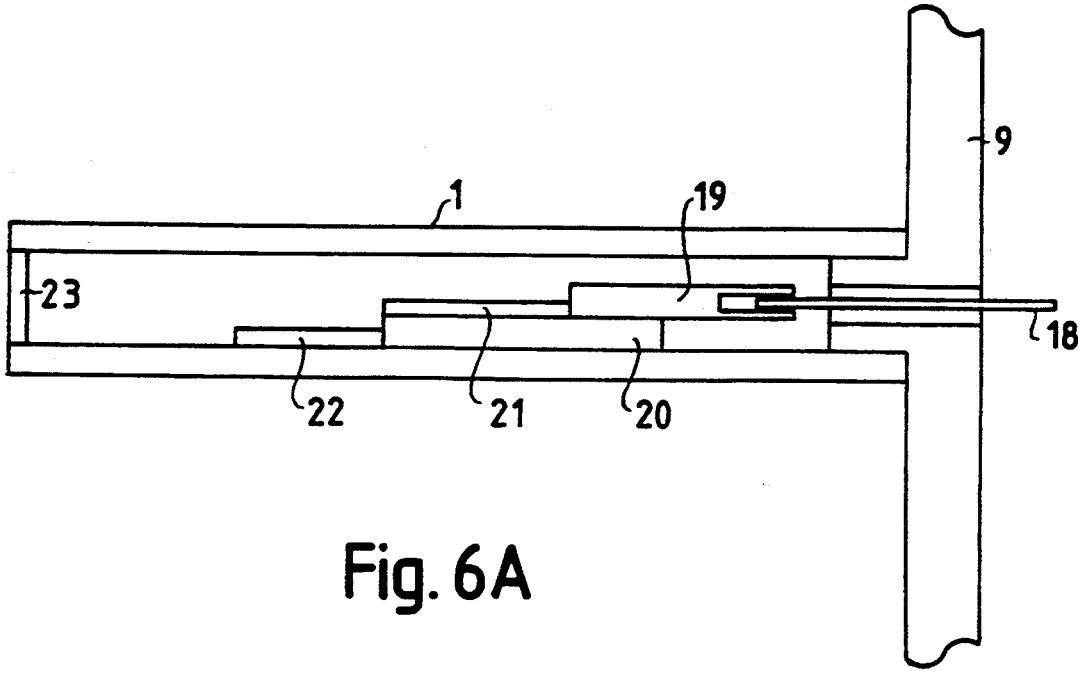
FIGS. 6A–6B represent the geometry of the integrated matching unit incorporated in each radiator.
Figure 6B:
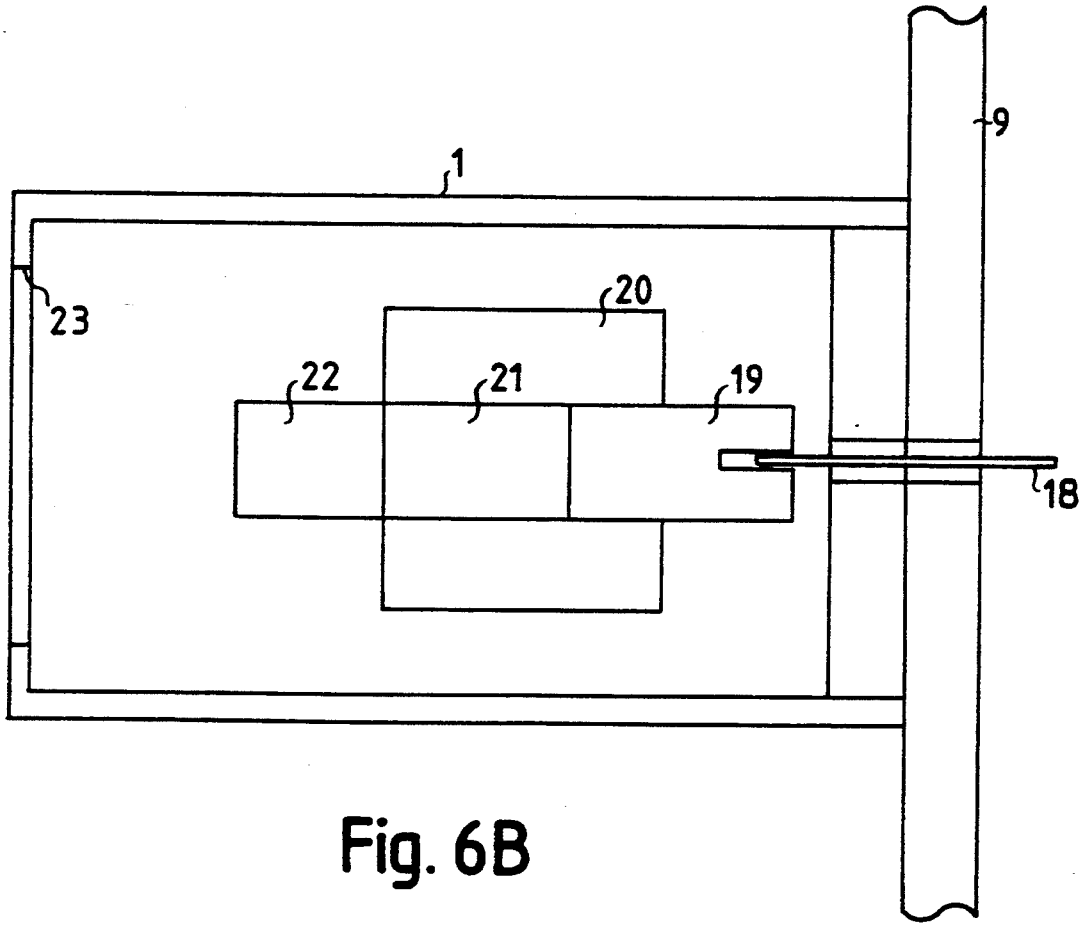

A well-known problem inherent in phased array systems is mutual coupling, the mutual interference of adjacent radiators. FIG. 6A shows in side-view and FIG. 6B shows in top-view an iris 23 which eliminates this problem in the antenna module according to the invention. To prevent mutual coupling in a large bandwidth, the width of the radiator at the free end of the radiator has been reduced to 85%. The radiator height remains unchanged.

A phased array system comprising antenna modules according to the invention is comparatively insensitive to strong external electromagnetic fields. This is due to the radiators constituting at least a substantially continuous surface so that electromagnetic fields are practically incapable of penetrating into the radiator interspaces. Moreover, the open-ended waveguide radiators have a well-defined cutoff frequency, below which the waveguide radiators do not pass energy.

In a monopulse phased array system, the output signals of all modules are summed on the basis of three different weighting functions to obtain a sum channel $\Sigma$, an elevation difference signal $\Delta E$ and an azimuth difference signal $\Delta B$. In this field of technology it is common practice to perform the required summations with the received RF signals; albeit after preamplification and phase shift.

The summation networks are then designed on the basis of RF technology and shall have the same bandwidth as the system bandwidth desired for the phased array system. For an extremely wideband phased array system, such as the system in question, such a summation network can hardly be realized, certainly not if requirements are formulated with respect to sidelobes in the difference channels $\Delta E$ and $\Delta B$. In view of this, the phased array system in question uses summation networks operating at a convenient intermediate frequency, for instance 100 MHz. Summation networks may then be designed as noncomplex resistance networks. The antenna modules shall then convert the received RF signals to this intermediate frequency. In view of the large system bandwidth, a single superheterodyne receiver is the obvious solution here. However, the drawback of a single superheterodyne receiver is that a good suppression of the image frequency is hardly attainable, as is generally assumed by the radar engineer. In the antenna module according to the invention the frequency conversion is effected by a conventional image rejection mixer, whose image rejection has been increased by the application of a monolithic microwave integrated circuit in GaAs technology. Furthermore, a most significant improvement of the image frequency suppression is obtained owing to the mirror signals originating from various modules not possessing a correlated phase, as in contrast to the virtual signals, so that the summation networks have an image-rejective effect. For example, the image rejection for a system of 1000 modules can be bettered by 30 dB when compared with the image rejection of an individual module. The image rejection mixer will then have to be designed such that the image signal, measured from sample to sample, displays a random distribution, at least substantially so. This means that systematic errors in the splitter-combination networks incorporated in the image rejection mixer have to be avoided.

I claim:

1. An active monopulse phased array antenna system, comprising:

a cooling plate having first and second planar sides;

a plurality of modules, each of the modules including:

a substantially flat housing;

four rectangular open-ended waveguide type radiators for transmission and reception of RF signals mounted to a first side of the housing;

input means for inputting RF signals, control signals, and supply voltages, mounted on a second side of the housing which is substantially opposite to the first side of the housing; and an electric circuit contained in the housing for simultaneously driving each of the radiators at a controllable phase;

wherein the housing has a bottom side for fitting to a planar side of the cooling plate and for transferring heat generated in the electric circuit to the cooling plate; and wherein the modules are mounted on the first and second planar sides of the cooling plate such that the radiators of modules which are mounted on the first planar side of the cooling plate are interlocked between radiators of modules mounted on the second planar side of the cooling plate which results in a staggered row of said radiators.

2. An antenna as claimed in claim 1, wherein the radiators each have a height H and interspaces of at least H.

3. An antenna as claimed in claim 2, wherein the radiators each have a width of substantially 3.5 H.

4. An antenna as claimed in claim 1, wherein the modules and the cooling plate are arranged such that ends of the radiators in the staggered row of radiators constitute an at least substantially continuous surface.

5. An antenna system, comprising:

at least one cooling plate having first and second planar sides;

a plurality of modules mounted on the first and second planar sides of said at least one cooling plate, each of said modules including a plurality of rectangular open-ended waveguide type radiators mounted to a housing, the radiators having a height H and a spacing between the radiators mounted to the housing being at least H;

wherein at least two of said plurality of modules are arranged such that the radiators of said at least two modules face in a same direction, and the radiators of one of said at least two modules located on the first planar side of said at least one cooling plate are interlocked between the radiators of another module of said at least two modules said another module located on the second planar side of said at least one cooling plate.

6. An antenna system according to claim 5, wherein said housings of said one module and said another of said at least two modules are mounted to a same one of said at least one cooling plate.

7. An antenna system according to claim 5, wherein 50% of one radiator of said one module is disposed between two of the radiators of said another of said at least two modules.

8. An antenna system according to claim 7, wherein said housing of said one module and said housing of said another of said at least two modules are mounted to a same one of said at least one cooling plate.

9. An antenna system according to claim 5, wherein said housing of said one module and said housing of said another of said at least two modules are mounted to opposite sides of said at least one cooling plate.

10. An antenna system, comprising:

a cooling plate having first and second planar sides;

a first module mounted on the first planar side, a second module mounted on the second planar side, each of said modules including a housing and a plurality of rectangular open-ended waveguide type radiators mounted to the housing thereof, the housing of each of said modules mounted to the cooling plate, the radiators having a height H and a spacing between the radiators mounted to the housing being at least H;

wherein the two modules are arranged such that the radiators of one of said modules face in a same direction as the radiators of the other of the two modules and the radiators of said one module are interlocked between the radiators of said other module.

11. An antenna system according to claim 10, wherein 50% of one radiator of said one module is disposed between two of the radiators of said other module.

12. An antenna system according to claim 10, wherein said housing of said one module and said housing of said other module are mounted to opposite sides of said cooling plate.

13. An antenna system according to claim 12, wherein 50% of one radiator of said one module is disposed between two of the radiators of said other module.

* * * * *

UNITED STATES PATENT AND TRADEMARK OFFICE

CERTIFICATE OF CORRECTION

PATENT NO. : 5,404,148

DATED : April 4, 1995

INVENTOR(S) : Johan M. C. ZWARTS

Figure 1C:
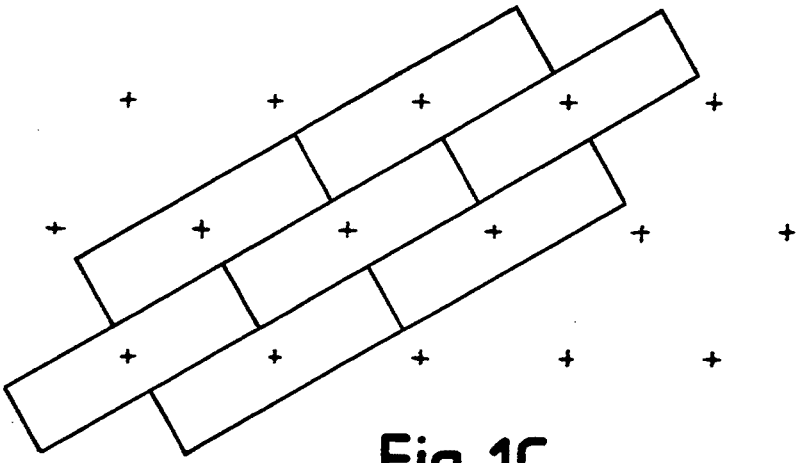
FIG. 1 gives an explanation on the antenna geometry, where

It is certified that error appears in the above-indentified patent and that said Letters Patent is hereby corrected as shown below:

Column 2, line 58, change "FIG 1G" to --FIG. 1C--.

Column 3, line 47, change "FIG 1G" to --FIG. 1C--.

Column 3, line 62, change "Joint" to --joint--.

Signed and Sealed this

Fifth Day of September, 1995

*Attest:*

*Attesting Officer*

Bruce Lehman

BRUCE LEHMAN

*Commissioner of Patents and Trademarks*